US009460609B2

(12) United States Patent
Lee et al.

(10) Patent No.: US 9,460,609 B2
(45) Date of Patent: Oct. 4, 2016

(54) METHOD AND APPARATUS FOR PREVENTING LOSING ELECTRONIC DEVICES

(71) Applicant: Samsung Electronics Co., Ltd., Suwon-si, Gyeonggi-do (KR)

(72) Inventors: Yongsuk Lee, Seoul (KR); Taeho Kang, Seongnam-si (KR); Sungwoo Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/631,161

(22) Filed: Feb. 25, 2015

(65) Prior Publication Data

US 2015/0254962 A1 Sep. 10, 2015

(30) Foreign Application Priority Data

Mar. 10, 2014 (KR) ..... 10-2014-0027592

(51) Int. Cl.

| | |
|---|---|
| ***G08B 1/08*** | (2006.01) |
| ***G08B 21/24*** | (2006.01) |
| *G08B 13/14* | (2006.01) |
| *G08B 21/02* | (2006.01) |

(52) U.S. Cl.

CPC ..... *G08B 21/24* (2013.01); *G08B 13/1436* (2013.01); *G08B 21/028* (2013.01)

(58) Field of Classification Search

CPC . G08B 21/24; G08B 21/028; G08B 13/1436

USPC ..... 340/539.32

See application file for complete search history.

(56) References Cited

U.S. PATENT DOCUMENTS

2013/0234885 A1* 9/2013 Geier ..... G01S 19/49 342/357.23
2015/0087232 A1* 3/2015 Sloan ..... G06F 19/3418 455/41.2

FOREIGN PATENT DOCUMENTS

| | | | |
|---|---|---|---|
| KR | 10-2006-0101964 | A | 9/2006 |
| KR | 10-0737767 | B1 | 7/2007 |
| KR | 10-2013-0076221 | A | 7/2013 |
| KR | 10-2013-0080903 | A | 7/2013 |

* cited by examiner

*Primary Examiner* — Tanmay Shah
(74) *Attorney, Agent, or Firm* — Jefferson IP Law, LLP

(57) ABSTRACT

A method and an apparatus for preventing the loss of an electronic device are provided. The method includes establishing a communication link between a first electronic device and a second electronic device through activation of wireless communication at the first electronic device, collecting, upon detection of movement of the first electronic device, sensing information of the first electronic device, receiving sensing information from the second electronic device through the communication link, comparing the sensing information of the first electronic device with the sensing information of the second electronic device, and checking whether a loss incident has occurred on the basis of the comparison result.

18 Claims, 13 Drawing Sheets

FIG. 12

| | WEARABLE DEVICE | | MOBILE DEVICE | |
|---|---|---|---|---|
| OWNED | SHAKING DETECTED | | SHAKING DETECTED | |
| | 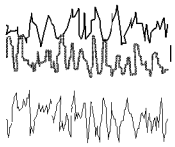 <a> | 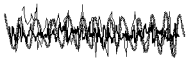 <b> | 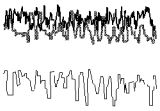 <c> | 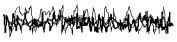 <d> |
| | ACCELERATION | ACCELERATION | ACCELERATION | ACCELERATION |
| | SHAKING DETECTED | | SHAKING NOT DETECTED | |
| | 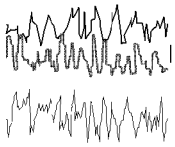 <e> | 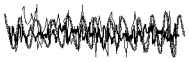 <f> | 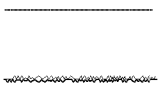 <g> |  <h> |
| | ACCELERATION | ACCELERATION | ACCELERATION | ACCELERATION |
| STOLEN | SHAKING DETECTED | | SHAKING DETECTED | |
| | 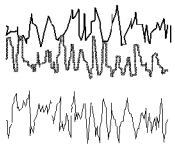 <i> | 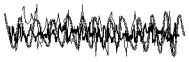 <j> | 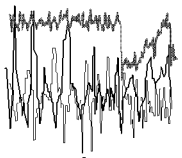 <k> | 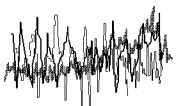 <l> |
| | ACCELERATION | ACCELERATION | ACCELERATION | ACCELERATION |
| | SHAKING NOT DETECTED | | SHAKING DETECTED | |
| | 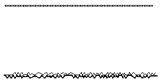 <m> |  <n> | 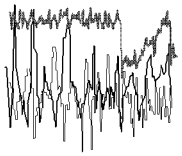 <o> | 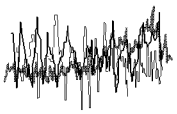 <p> |
| | ACCELERATION | ACCELERATION | ACCELERATION | ACCELERATION |

METHOD AND APPARATUS FOR PREVENTING LOSING ELECTRONIC DEVICES

CROSS-REFERENCE TO RELATED APPLICATION(S)

This application claims the benefit under 35 U.S.C. §119 (a) of a Korean patent application filed on Mar. 10, 2014 in the Korean Intellectual Property Office and assigned Serial No. 10-2014-0027592, the entire disclosure of which is hereby incorporated by reference.

TECHNICAL FIELD

The present disclosure relates to a method and apparatus for preventing the loss of an electronic device.

BACKGROUND

In recent years, electronic devices have evolved into a variety of mobile devices (such as smartphones and tablet computers that may be carried by users) and wearable devices (such as wristwatches and eyeglasses that may be worn by users). In particular, wearable devices have been made smaller, lighter and more stylish so as to be worn by users at all times.

Meanwhile, when an electronic device detects motion in a particular direction, it may determine that a loss incident has occurred and report a loss notification to the user.

The above information is presented as background information only to assist with an understanding of the present disclosure. No determination has been made, and no assertion is made, as to whether any of the above might be applicable as prior art with regard to the present disclosure.

SUMMARY

However, as the criterion for directions may frequently change according to the orientation of an electronic device being carried by the user, a loss notification may be falsely issued when no loss incident has occurred.

Aspects of the present disclosure are to address at least the above-mentioned problems and/or disadvantages and to provide at least the advantages described below. Accordingly, an aspect of the present disclosure is to provide a method and apparatus for preventing the loss of an electronic device wherein pieces of sensing information related to motion obtained from a first electronic device and a second electronic device connected through a communication link are compared to determine and report the occurrence of a loss incident.

In accordance with an aspect of the present disclosure, a method of loss prevention for electronic devices is provided. The method includes establishing a communication link between a first electronic device and a second electronic device through activation of wireless communication at the first electronic device, collecting, upon detection of movement of the first electronic device, sensing information of the first electronic device, receiving sensing information from the second electronic device through the communication link, comparing the sensing information of the first electronic device with the sensing information of the second electronic device, and checking whether a loss incident has occurred on the basis of the comparison result.

In accordance with another aspect of the present disclosure, a method of loss prevention for electronic devices is provided. The method includes establishing a communication link between a first electronic device and a second electronic device through activation of wireless communication at the second electronic device, collecting, upon detection of movement of the second electronic device, sensing information of the second electronic device, sending the collected sensing information to the first electronic device through the communication link, receiving loss information from the first electronic device, and generating, upon reception of the loss information, a loss notification.

In accordance with another aspect of the present disclosure, an electronic device supporting loss prevention is provided. The electronic device includes a sensor unit configured to sense motion of the electronic device, a communication unit configured to send and receive sensing information related to motion, and a control unit configured to control a process of establishing a communication link with a second electronic device through activation of wireless communication, collecting, upon detection of movement of the electronic device, sensing information of the electronic device, receiving sensing information from the second electronic device through the communication link, comparing the sensing information of the electronic device with the sensing information of the second electronic device, and checking whether a loss incident has occurred on the basis of the comparison result.

In accordance with another aspect of the present disclosure, an electronic device supporting loss prevention is provided. The electronic device includes a sensor unit configured to sense motion of the electronic device, a communication unit configured to send and receive sensing information related to motion, and a control unit configured to control a process of establishing a communication link with a second electronic device through activation of wireless communication, collecting, upon detection of movement of the electronic device, sensing information of the electronic device, sending the collected sensing information to the second electronic device through the communication link, and generating, upon reception of loss information from the second electronic device, a loss notification.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which:

FIG. 12 illustrates signal patterns based on sensing information used to determine the occurrence of a loss incident according to an embodiment of the present disclosure.

Throughout the drawings, it should be noted that like reference numbers are used to depict the same or similar elements, features, and structures.

DETAILED DESCRIPTION

Figure 1:
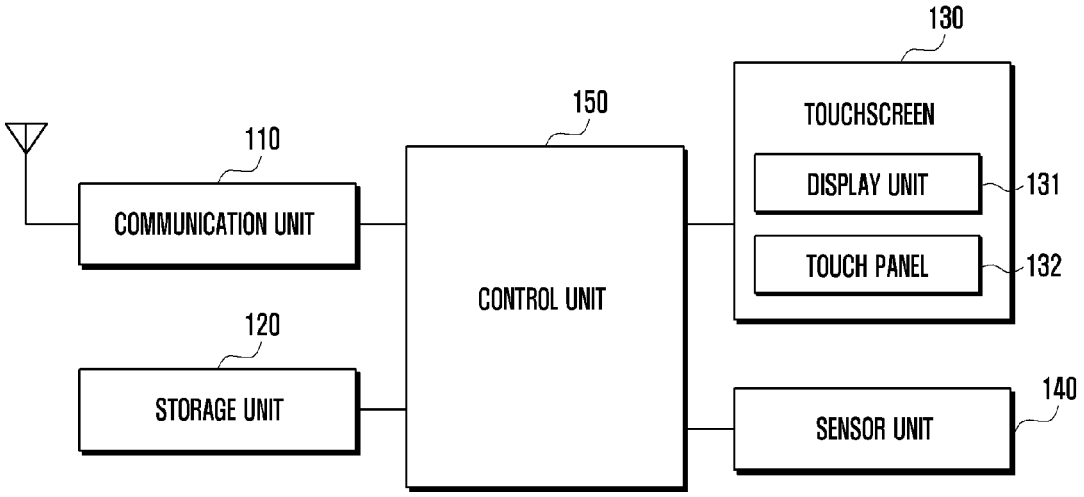
FIG. 1 is a block diagram of an electronic device having touch capabilities according to an embodiment of the present disclosure.

The following description with reference to the accompanying drawings is provided to assist in a comprehensive understanding of various embodiments of the present disclosure as defined by the claims and their equivalents. It includes various specific details to assist understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

It will be understood that the terms "comprising", "including", "having" and variants thereof, when used in this description, specify the presence of stated features, operations, elements, and/or components, but do not preclude the presence or addition of one or more other features, operations, elements, components, and/or combinations thereof.

Further, unless expressly stated to the contrary, "or" refers to an inclusive or and not to an exclusive or. For example, a condition A or B may be satisfied by any one of the following: A is true (or present) and B is false (or absent), A is false (or absent) and B is true (or present), and both A and B are true (or present).

The terms first, second, third and the like in the description are used for distinguishing between similar elements and not necessarily for describing a sequential or chronological order. For example, a first electronic device and a second electronic device may be used to refer to different user equipments (UEs). It is to be understood that the terms so used are interchangeable under appropriate circumstances.

Unless defined otherwise, all technical and scientific terms used herein have the same meaning as commonly understood by one of ordinary skill in the art to which the disclosure belongs. The meaning of specific terms or words used in the specification and the claims should not be limited to the literal or commonly employed sense, but should be construed in accordance with the spirit of the present disclosure.

The electronic device according to the present disclosure may be a device having a communication function. For example, the electronic device may be one of a smartphone, a tablet personal computer, a mobile phone, a video phone, an e-book reader, a desktop personal computer, a laptop personal computer, a netbook computer, a personal digital assistant (PDA), a portable multimedia player (PMP), a moving picture experts group (MPEG) audio layer 3 (MP3) player, a mobile medical appliance, a camera, and a wearable device (e.g., electronic eyeglasses, a head-mounted device (HMD), electronic clothing, electronic bracelet, electronic necklace, electronic appcessory, electronic tattoo, or smartwatch).

In various embodiments of the present disclosure, pieces of motion information collected respectively from a wearable device and a mobile device may be compared to determine whether a loss incident has occurred. The motion of the wearable device worn by the user may conform to the motion of the user. The motion of the mobile device is analyzed when the wearable device is worn by the user. Motion data of the wearable device may be compared with motion data of the mobile device to determine whether a loss incident has occurred. More specifically, signal patterns of a gyro sensor module and an acceleration sensor module in the wearable device may be compared respectively with signal patterns of a gyro sensor module and an acceleration sensor module in the mobile device. When signals of the wearable device change independently, or when signals of the wearable device change in a pattern similar to those of the mobile device, it may be determined that a loss incident has not occurred. When independent motion-related signals are detected from the mobile device while the wearable device is being worn, it may be determined that the motion is caused by a third person other than the owner and a loss notification may be issued. In addition, when short-range communication between the two devices is not possible, an "out of short-range communication range" indication may be provided to the two devices.

Additionally, "sensing information" may indicate signal information generated by at least one of a geomagnetic sensor and an acceleration sensor according to motion of an electronic device.

FIG. 1 is a block diagram of an electronic device having touch capabilities according to an embodiment of the present disclosure.

In an embodiment, a first electronic device 101 and a second electronic device 102 have the same configuration as the electronic device of FIG. 1. Therefore, the description of a configuration of an electronic device may be applied to the first electronic device 101 and the second electronic device 102.

Referring to FIG. 1, the electronic device of the present disclosure may include a communication unit 110, a storage unit 120, a touchscreen 130, a sensor unit 140, and a control unit 150.

The communication unit 110 performs voice, video or data communication with an external device. In various embodiments, the communication may be performed directly or through a network. The communication unit 110 may include a radio frequency transmitter for upconverting the frequency of a signal to be transmitted and amplifying the signal, and a radio frequency receiver for low-noise amplifying a received signal and downconverting the frequency of the received signal. The communication unit 110 may include a modulator and demodulator to perform modulation and demodulation in accordance with code division multiple access (CDMA), wideband CDMA (WCDMA), long term evolution (LTE), wireless fidelity (Wi-Fi), wireless-broadband (WiBro), bluetooth (BT), near field communication (NFC), infrared data association (IrDA), radio frequency identification (RFID) and ultrasonic communication. The communication unit 110 may include a mobile communication module, Internet communication module, and/or short-range communication module.

For example, the communication unit 110 may send and receive sensing information regarding motion of the electronic device and loss information thereof to and from another electronic device.

The storage unit 120 may include a program area to store executable programs of the electronic device, and a data area to store data generated during program execution.

The touchscreen 130 may include a display unit 131 and a touch panel 132 as a single entity. The display unit 131 may display various screens in the course of operating the electronic device under control of the control unit 150. The display unit 131 may be realized using liquid crystal display (LCD) elements, organic light-emitting diodes (OLED), an active-matrix OLED (AMOLED), a flexible display, a bended display, and a three dimensional display. The display unit 131 may be configured to be flexible, transparent or wearable. The touch panel 132 may be a composite touch panel composed of a hand touch panel to sense hand gestures and a pen touch panel to sense pen gestures.

The sensor unit 140 is configured to collect sensing information related to state changes of the electronic device. For example, the sensor unit 140 may include an acceleration sensor, a gyro sensor and a geomagnetic sensor, and may further include at least one of a proximity sensor, a Global Positioning System (GPS) module, a camera module, a motion sensor, a gravity sensor, and a dynamic vision sensor.

In one embodiment, the sensor unit 140 may collect sensing information regarding motion of the electronic device and forward the same to the control unit 150.

The control unit 150 controls the overall operation of the electronic device, controls signal exchange between internal components thereof, performs data processing, and controls a supply of power from a battery to the internal components.

In one embodiment, the control unit 150 may establish a wireless communication link with a second electronic device. After establishment of the wireless communication link, the control unit 150 may collect sensing information regarding motion of the electronic device. When sensing information regarding motion of the second electronic device is received from the second electronic device, the control unit 150 may compare the sensing information collected from the electronic device with that received from the second electronic device. If the collected sensing information and the received sensing information exhibit a similar signal pattern, the control unit 150 may not issue a loss notification. If the collected sensing information and the received sensing information exhibit different signal patterns, the control unit 150 may issue a loss notification.

The electronic device may further include supplementary components, such as a GPS receiver to receive position information, a broadcast reception module to receive broadcasts, and an input unit supporting hard key based input. Such supplementary components will not be described or shown in further detail.

In an embodiment of the present disclosure, one of the first electronic device 101 and the second electronic device 102 may include a comparator. The electronic device having the comparator determines occurrence of a loss incident and sends loss information to the other electronic device. In the following description with reference to FIGS. 2 to 6, it is assumed that the second electronic device 102 includes a comparator and sends loss information to the first electronic device 101.

Figure 2:
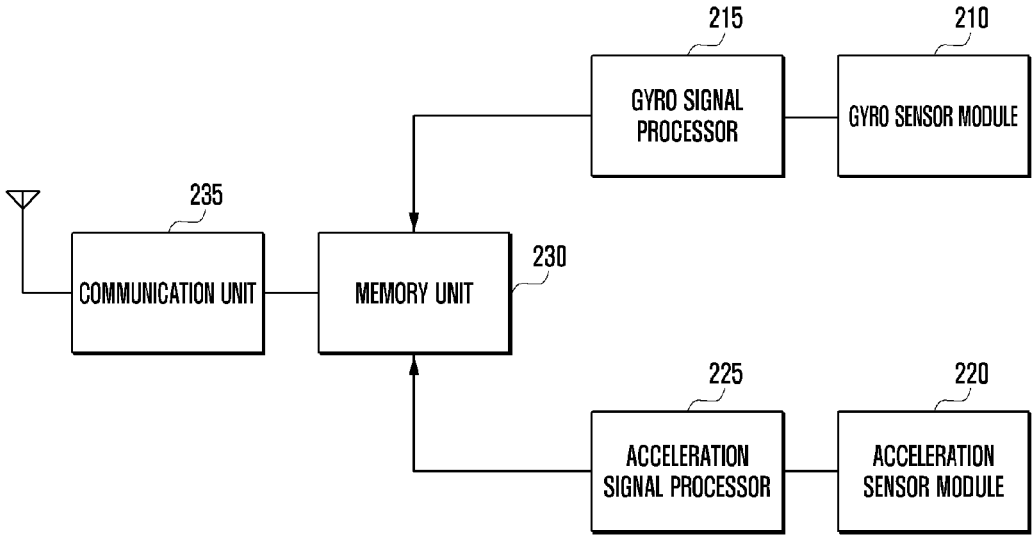
FIG. 2 is a block diagram of a first electronic device according to an embodiment of the present disclosure.

FIG. 2 is a block diagram of a first electronic device according to an embodiment of the present disclosure.

Referring to FIG. 2, the first electronic device 101 may include a gyro sensor module 210, a gyro signal processor 215, an acceleration sensor module 220, an acceleration signal processor 225, a memory unit 230, and a communication unit 240.

When the first electronic device 101 is configured to support screen rotation, the gyro sensor module 210 may be activated to sense angular velocity. Angular velocity information collected by the gyro sensor module 210 may be forwarded to the gyro signal processor 215. The angular velocity information may include information on rotation along at least one of the x-axis, y-axis and z-axis. Sensing information collected by the gyro sensor module 210 may include information on the angular velocity about at least one of the x-axis, y-axis and z-axis.

The gyro signal processor 215 may receive sensing information collected by the gyro sensor module 210 and forward the same to the memory unit 230.

The acceleration sensor module 220 may sense acceleration due to motion (such as rotation) of the first electronic device 101. Acceleration information collected by the acceleration sensor module 220 may be forwarded to the acceleration signal processor 225.

The acceleration signal processor 225 may receive sensing information related to acceleration collected by the acceleration sensor module 220 and forward the same to the memory unit 230.

The memory unit 230 may store sensing information of the first electronic device 101 collected by the gyro sensor module 210 and/or the acceleration sensor module 220.

The communication unit 240 may send sensing information of the first electronic device 101 collected by the gyro sensor module 210 and/or the acceleration sensor module 220 to the second electronic device 102. In addition, the communication unit 240 may receive loss information from the second electronic device 102.

Figure 3:
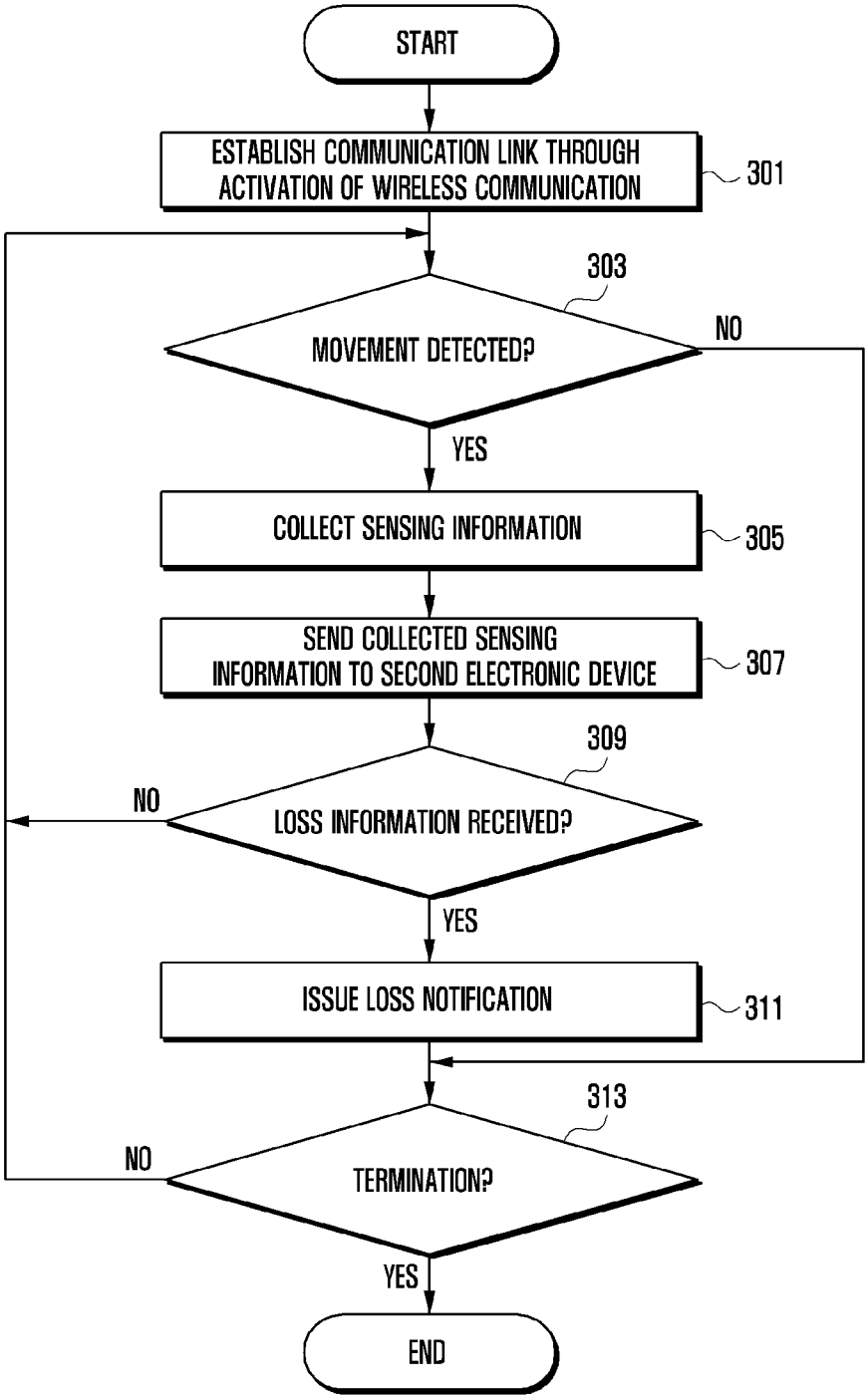
FIG. 3 is a flowchart of a loss prevention method for a first electronic device according to an embodiment of the present disclosure.

FIG. 3 is a flowchart of a loss prevention method for a first electronic device according to an embodiment of the present disclosure.

Referring to FIG. 3, at operation 301, the control unit 150 of the first electronic device 101 activates wireless communication and establishes a communication link with another electronic device. Here, it is assumed that the communication link is established between the first electronic device 101 and the second electronic device 102. After establishment of the communication link, the control unit 150 checks whether motion of the first electronic device 101 is detected at operation 303. If motion of the first electronic device 101 is detected, the control unit 150 controls the sensor unit 140 to collect sensing information of the first electronic device 101 at operation 305. Here, the sensing information may be collected by an acceleration sensor and/or a geomagnetic sensor sensing motion of the first electronic device 101. For example, the control unit 150 may collect acceleration sensor signal information through the acceleration sensor according to motion of the first electronic device 101 and store the same in the storage unit 120. The control unit 150 may also collect geomagnetic sensor signal information through the geomagnetic sensor according to motion of the first electronic device 101 and store the same in the storage unit 120.

At operation 307, the control unit 150 sends the sensing information collected from the first electronic device 101 through the communication link to the second electronic device 102. Thereafter, the control unit 150 checks whether loss information is received from the second electronic device 102 at operation 309. If loss information is not received, the procedure returns to operation 303. If loss information is received from the second electronic device 102, the control unit 150 issues a loss notification at operation 311. Here, the loss notification may be issued using vibration or sound, and the loss notification may be displayed together with information tracking the movement path of the lost electronic device on the display unit 131.

At operation 313, the control unit 150 checks whether a termination command is issued. Here, the termination command may correspond to release of the communication link due to deactivation of wireless communication. If a termination command is issued, the procedure ends. If a termination command is not issued, the procedure returns to operation 303 and motion sensing is continued.

Figure 4:
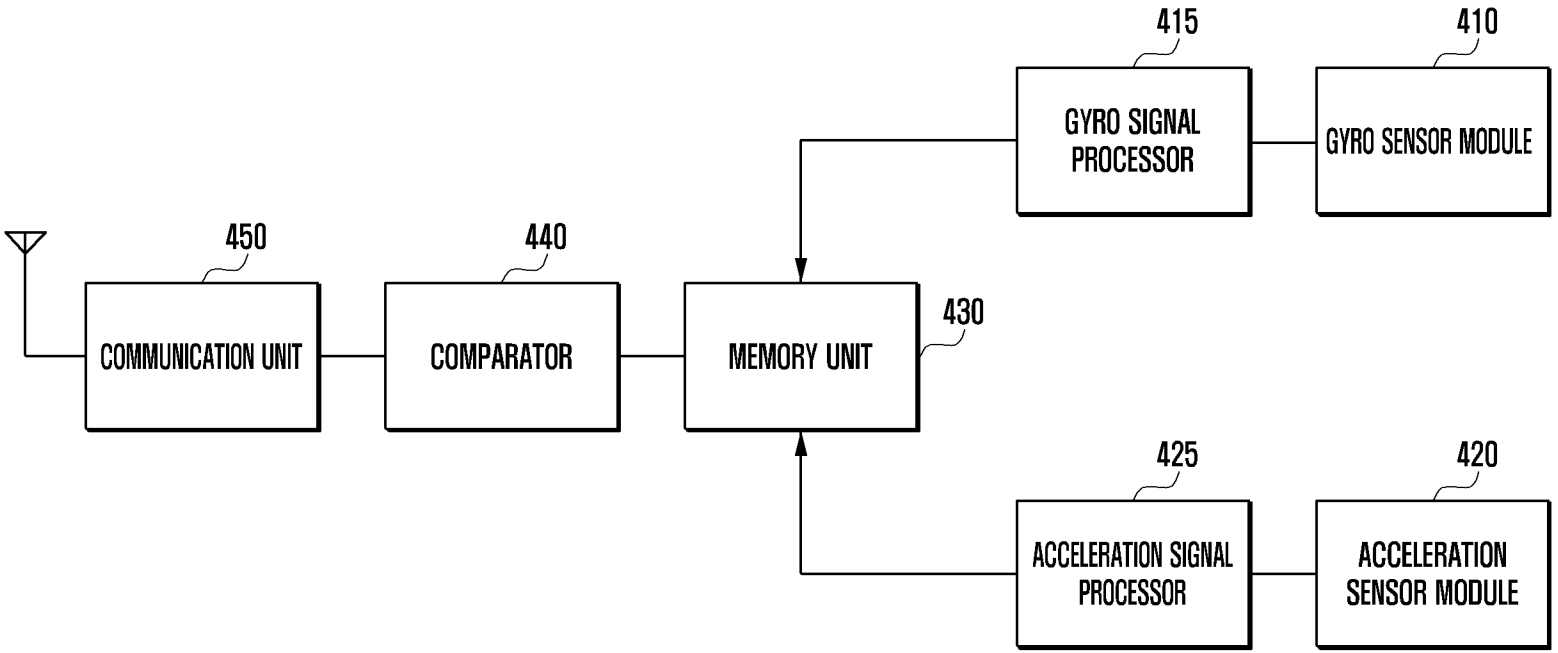
FIG. 4 is a block diagram of a second electronic device according to an embodiment of the present disclosure.

FIG. 4 is a block diagram of a second electronic device according to an embodiment of the present disclosure.

Referring to FIG. 4, the second electronic device 102 may include a gyro sensor module 410, a gyro signal processor 415, an acceleration sensor module 420, an acceleration signal processor 425, a memory unit 430, a comparator 440, and a communication unit 450.

When the second electronic device 102 is configured to support screen rotation, the gyro sensor module 410 may be activated to sense the angular velocity. Angular velocity information collected by the gyro sensor module 410 may be forwarded to the gyro signal processor 415. The angular velocity information may include information on rotation along at least one of the x-axis, y-axis and z-axis. Sensing information collected by the gyro sensor module 410 may include information on the angular velocity about at least one of the x-axis, y-axis and z-axis.

The gyro signal processor 415 may receive sensing information collected by the gyro sensor module 410 and forward the same to the memory unit 430.

The acceleration sensor module 420 may sense acceleration due to motion (such as rotation) of the second electronic device 102. Acceleration information collected by the acceleration sensor module 420 may be forwarded to the acceleration signal processor 425.

The acceleration signal processor 425 may receive sensing information related to acceleration collected by the acceleration sensor module 420 and forward the same to the memory unit 430.

The memory unit 430 may store sensing information of the second electronic device 102 collected by the gyro sensor module 410 and/or the acceleration sensor module 420.

The comparator 440 may analyze sensing information collected by the gyro sensor module 410 and/or the acceleration sensor module 420 to identify signal patterns for determining occurrence of a loss incident. For example, the comparator 440 may compare sensing information of the second electronic device 102 stored in the memory unit 430 with sensing information received from the first electronic device 101.

The communication unit 450 may receive sensing information of the first electronic device 101 therefrom. In addition, when the result of comparison by the comparator 440 indicates occurrence of a loss incident, the communication unit 450 may send loss information to the first electronic device 101.

Figure 5:
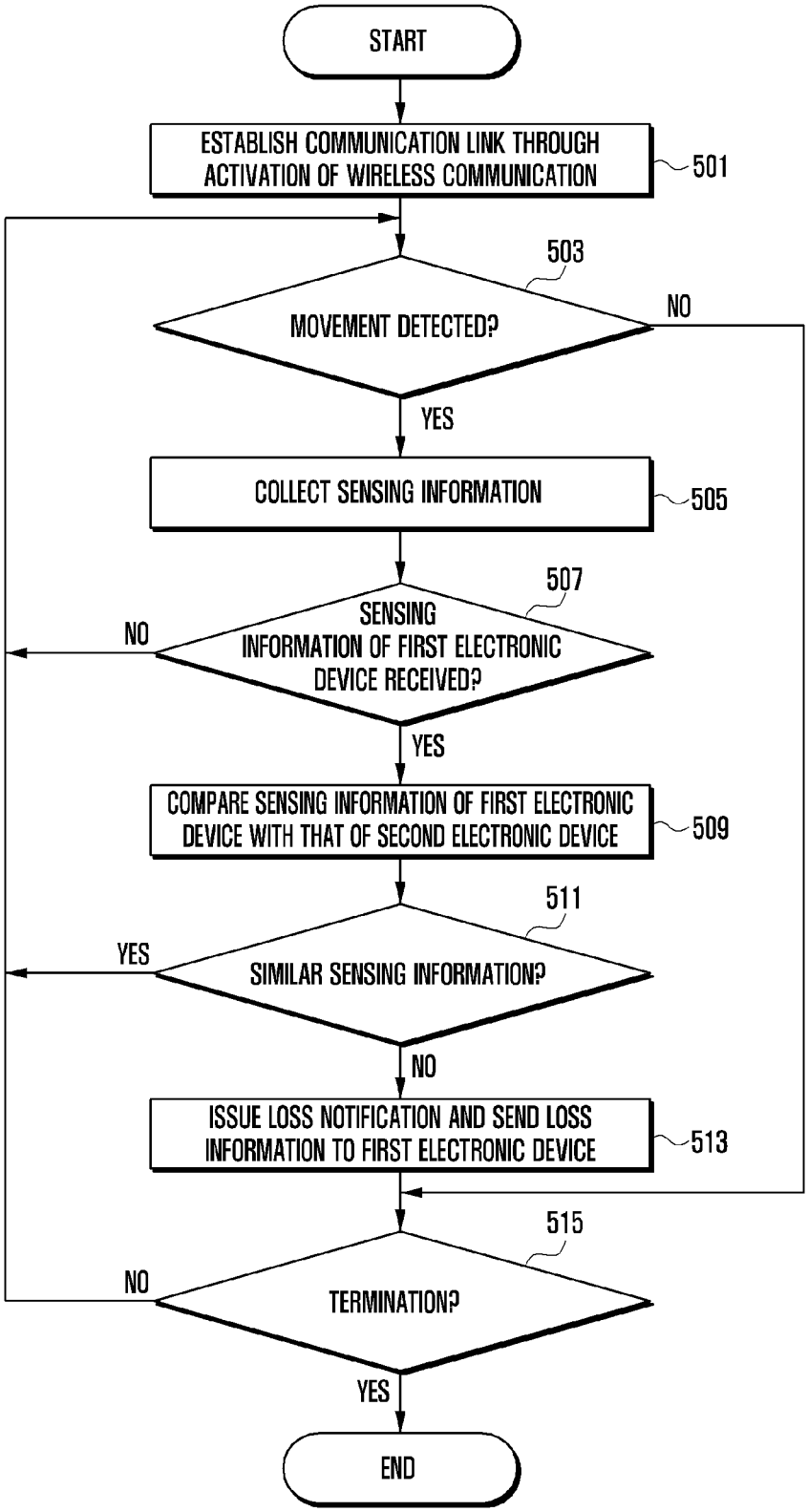
FIG. 5 is a flowchart of a loss prevention method for a second electronic device according to an embodiment of the present disclosure.

FIG. 5 is a flowchart of a loss prevention method for a second electronic device according to an embodiment of the present disclosure.

Referring to FIG. 5, the control unit 150 of the second electronic device 102 activates wireless communication and establishes a communication link with another electronic device at operation 501. Here, it is assumed that the communication link is established between the first electronic device 101 and the second electronic device 102. After establishment of the communication link, the control unit 150 checks whether motion of the second electronic device 102 is detected at operation 503. If motion of the second electronic device 102 is detected, the control unit 150 controls the sensor unit 140 to collect sensing information of the second electronic device 102 at operation 505. Here, the sensing information may be collected by an acceleration sensor and/or a geomagnetic sensor sensing motion of the second electronic device 102. For example, the control unit 150 may collect acceleration sensor signal information through the acceleration sensor according to motion of the second electronic device 102 and store the same in the storage unit 120. The control unit 150 may also collect geomagnetic sensor signal information through the geomagnetic sensor according to motion of the second electronic device 102 and store the same in the storage unit 120.

At operation 507, the control unit 150 checks whether sensing information of the first electronic device 101 is received through the communication link. If sensing information of the first electronic device 101 is received, the control unit 150 compares the received sensing information of the first electronic device 101 with the collected sensing information of the second electronic device 102 at operation 509. Here, detected signal patterns reflecting motion of the first electronic device 101 are compared with those reflecting motion of the second electronic device 102 to thereby identify occurrence of a loss incident.

At operation 511, the control unit 150 checks whether the received sensing information of the first electronic device 101 is similar to the collected sensing information of the second electronic device 102. If the received sensing information is not similar to the collected sensing information, the control unit 150 issues a loss notification and sends loss information to the first electronic device 101 at operation 513. At operation 515, the control unit 150 checks whether a termination command is issued. Here, the termination command may correspond to release of the communication link due to deactivation of wireless communication. If a termination command is issued, the procedure ends. If a termination command is not issued, the procedure returns to operation 503 and motion sensing is continued.

If motion of the second electronic device 102 is not detected at operation 503, the procedure proceeds to operation 515 at which the control unit 150 checks whether a termination command is issued. In the above description, the control unit 150 is depicted as determining whether to terminate the procedure. However, the present disclosure is not limited thereto.

To sum up, sensing information of the first electronic device 101 is compared with that of the second electronic device 102. If the two pieces of the sensing information show a similar signal pattern, it may be determined that a loss incident has not occurred. If the two pieces of the sensing information show different signal patterns, it may be determined that a loss incident has occurred, and a loss notification may be issued. Here, the loss notification may be issued using vibration or sound, and the loss notification may be displayed together with information tracking the movement path of the lost electronic device on the display unit 131.

Figure 6:
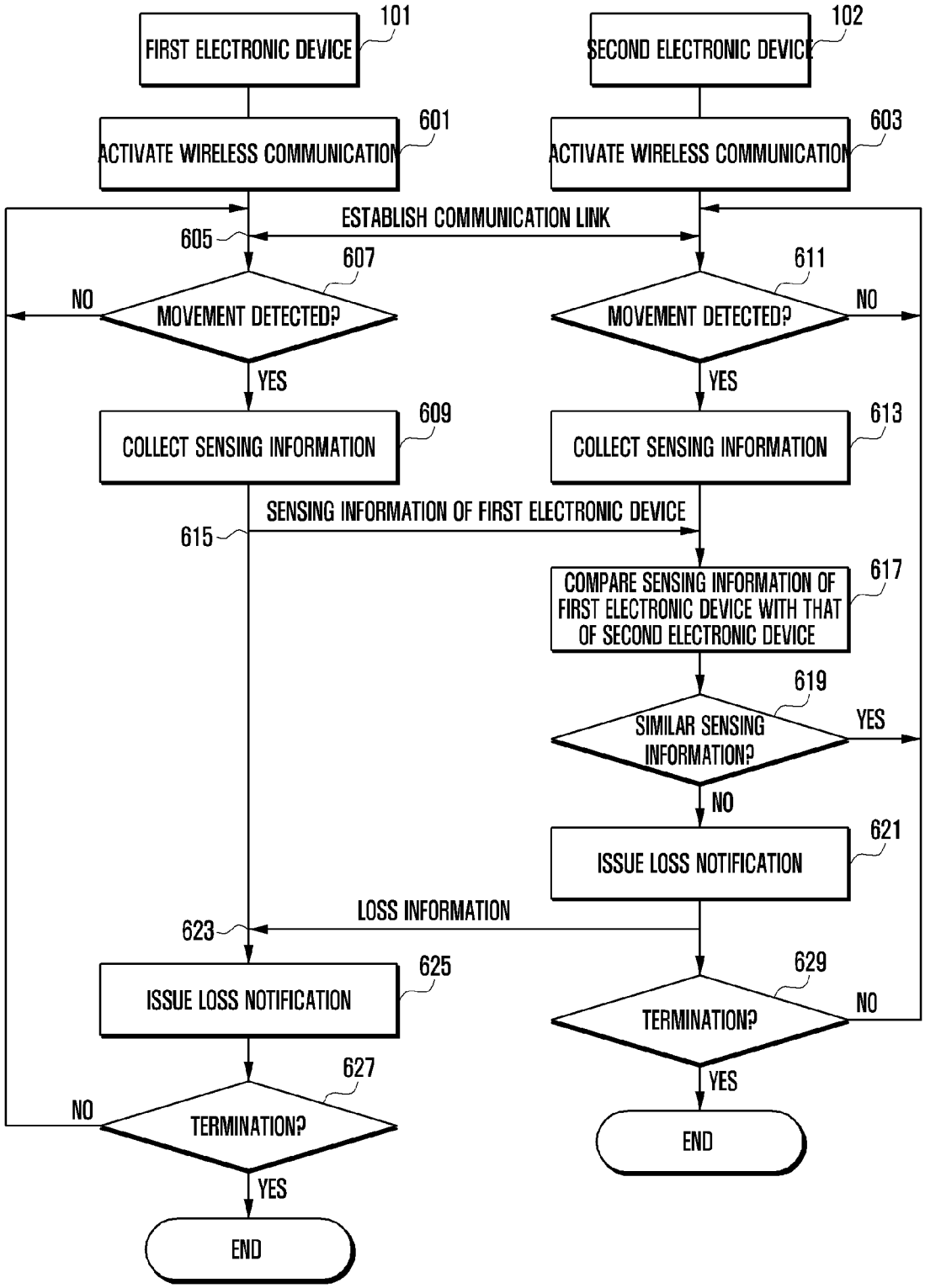
FIG. 6 illustrates signal exchange between a first electronic device and a second electronic device according to an embodiment of the present disclosure.

FIG. 6 illustrates signal exchange between a first electronic device and a second electronic device according to an embodiment of the present disclosure.

Referring to FIG. 6, the first electronic device 101 activates wireless communication at operation 601. At operation 603, the second electronic device 102 activates wireless communication. At operation 605, a communication link is established between the first electronic device 101 and the second electronic device 102. Thereafter, at operation 607, the first electronic device 101 checks whether motion thereof is detected. If motion of the first electronic device 101 is detected, the first electronic device 101 collects sensing information according to motion at operation 609. At operation 611, the second electronic device 102 checks whether motion thereof is detected. If motion of the second electronic device 102 is detected, the second electronic device 102 collects sensing information according to motion at operation 613.

At operation 615, the first electronic device 101 sends the collected sensing information to the second electronic device 102. Upon reception of the sensing information, the second electronic device 102 compares the received sensing information of the first electronic device 101 with the collected sensing information of the second electronic device 102 at operation 617. At operation 619, the second electronic device 102 checks whether the received sensing information of the first electronic device 101 shows a signal pattern similar to that of the collected sensing information of the second electronic device 102. If the received sensing information shows a signal pattern similar to that of the collected sensing information, the second electronic device 102 returns to operation 611. If the received sensing information shows a signal pattern dissimilar to that of the collected sensing information, the second electronic device 102 issues a loss notification at operation 621. At operation 623, the second electronic device 102 sends loss information to the first electronic device 101. Upon reception of the loss information, the first electronic device 101 issues a loss notification at operation 625. Following operation 625, the first electronic device 101 checks whether a termination command is issued at operation 627. Here, the termination command may correspond to release of the communication link due to deactivation of wireless communication. If a termination command is issued, the procedure ends. If a termination command is not issued, the procedure returns to operation 605. Similarly, following operation 621, the second electronic device 102 checks whether a termination command is issued at operation 629. Here, the termination command may correspond to release of the communication link due to deactivation of wireless communication. If a termination command is issued, the procedure ends. If a termination command is not issued, the procedure returns to operation 605. In the above description, both of the first electronic device 101 and the second electronic device 102 are described as generating a loss notification. However, the present disclosure is not limited thereto. For example, only the electronic device worn by the user such as a wearable device may issue a loss notification.

In another embodiment, each of the first electronic device 101 and the second electronic device 102 may include a comparator, and one electronic device may determine occurrence of a loss incident, issue a loss notification, and send loss information to the other electronic device. In the following description with reference to FIGS. 7 to 11, it is assumed that the first electronic device 101 and the second electronic device 102 both include a comparator and exchange loss information each other.

Figure 7:
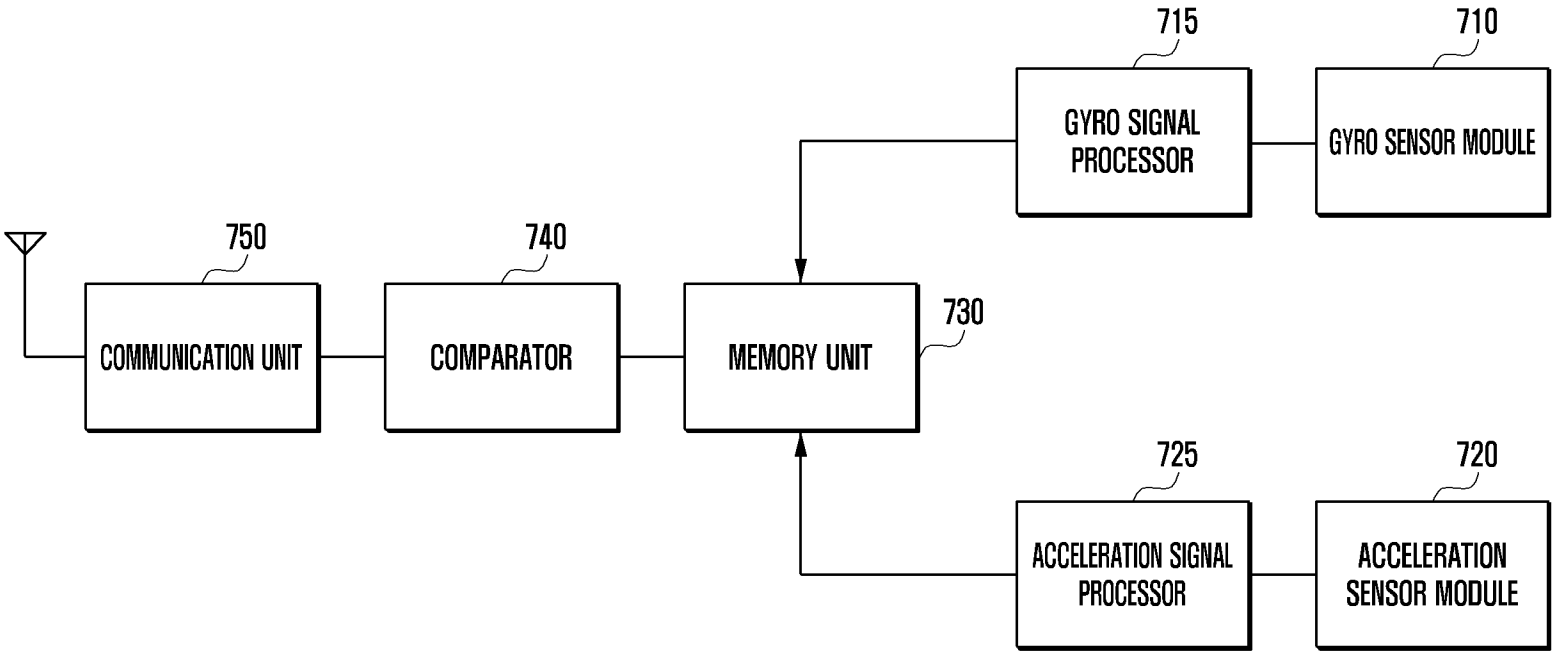
FIG. 7 is a block diagram of a first electronic device according to an embodiment of the present disclosure.

FIG. 7 is a block diagram of a first electronic device according to an embodiment of the present disclosure.

Referring to FIG. 7, the first electronic device 101 may include a gyro sensor module 710, a gyro signal processor 715, an acceleration sensor module 720, an acceleration signal processor 725, a memory unit 730, a comparator 740, and a communication unit 750.

When the first electronic device 101 is configured to support screen rotation, the gyro sensor module 710 may be activated to sense the angular velocity. Angular velocity information collected by the gyro sensor module 710 may be forwarded to the gyro signal processor 715. The angular velocity information may include information on rotation along at least one of the x-axis, y-axis and z-axis. Sensing information collected by the gyro sensor module 710 may include information on the angular velocity about at least one of the x-axis, y-axis and z-axis.

The gyro signal processor 715 may receive sensing information collected by the gyro sensor module 710 and forward the same to the memory unit 730.

The acceleration sensor module 720 may sense acceleration due to motion (such as rotation) of the first electronic device 101. Acceleration information collected by the acceleration sensor module 720 may be forwarded to the acceleration signal processor 725.

The acceleration signal processor 725 may receive sensing information related to acceleration collected by the acceleration sensor module 720 and forward the same to the memory unit 730.

The memory unit 730 may store sensing information of the first electronic device 101 collected by the gyro sensor module 710 and/or the acceleration sensor module 720.

The comparator 740 may analyze sensing information collected by the gyro sensor module 710 and/or the acceleration sensor module 720 to identify signal patterns for determining occurrence of a loss incident. For example, the comparator 740 may compare sensing information of the first electronic device 101 stored in the memory unit 430 with sensing information received from the second electronic device 102.

The communication unit 750 may send sensing information of the first electronic device 101 collected by the gyro sensor module 710 and/or the acceleration sensor module 720 to the second electronic device 102. The communication unit 750 may receive sensing information of the second electronic device 102 therefrom. In addition, when the result of comparison by the comparator 740 indicates occurrence of a loss incident, the communication unit 750 may send loss information to the second electronic device 102.

Figure 8:
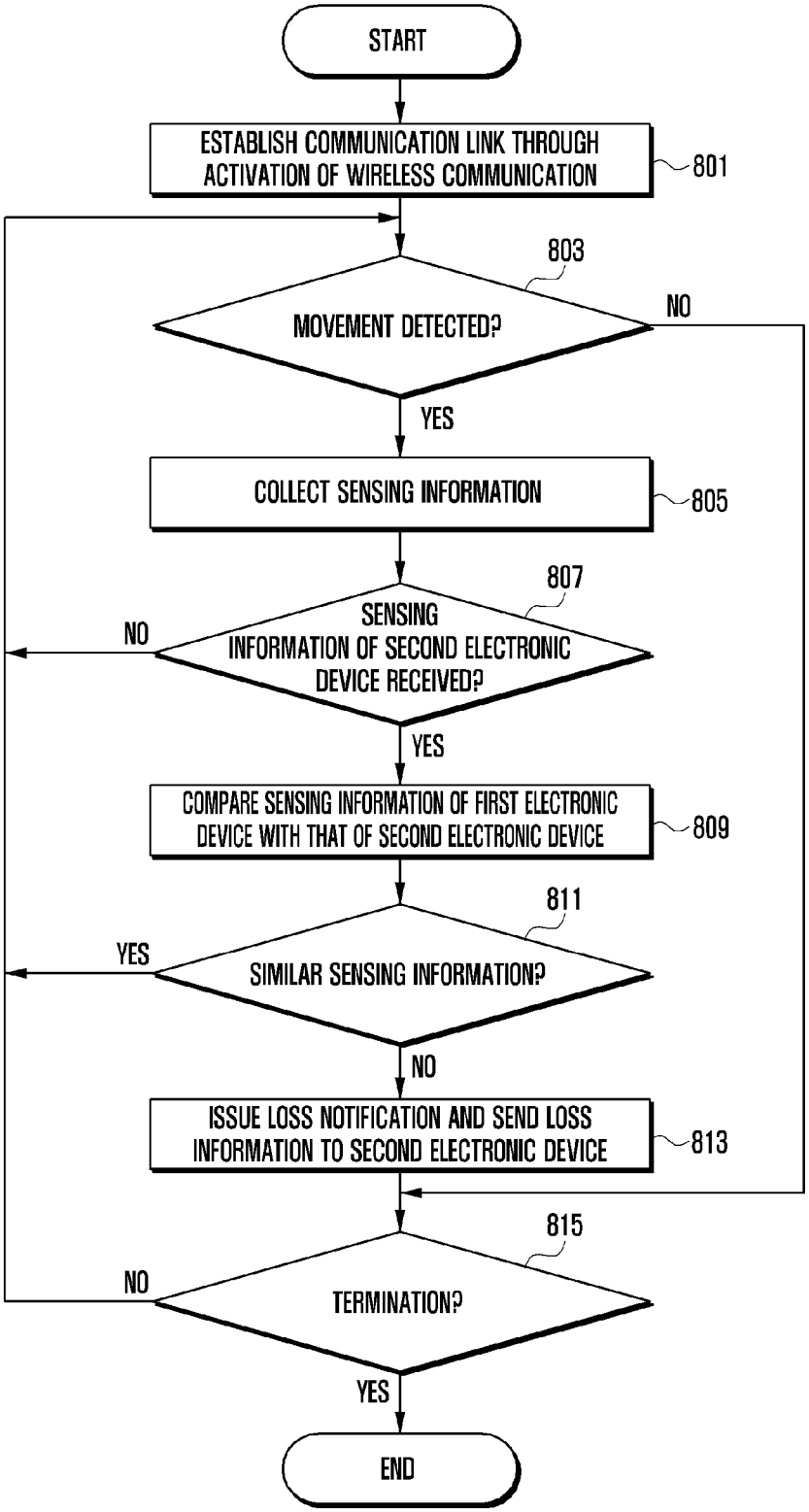
FIG. 8 is a flowchart of a loss prevention method for a first electronic device according to an embodiment of the present disclosure.

FIG. 8 is a flowchart of a loss prevention method for a first electronic device according to an embodiment of the present disclosure.

Referring to FIG. 8, the control unit 150 of the first electronic device 101 activates wireless communication and establishes a communication link with another electronic device at operation 801. Here, it is assumed that the communication link is established between the first electronic device 101 and the second electronic device 102. After establishment of the communication link, the control unit 150 checks whether motion of the first electronic device 101 is detected at operation 803. If motion of the first electronic device 101 is detected, the control unit 150 controls the sensor unit 140 to collect sensing information of the first electronic device 101 at operation 805. Here, the sensing information may be collected by an acceleration sensor and/or a geomagnetic sensor sensing motion of the first electronic device 101. For example, the control unit 150 may collect acceleration sensor signal information through the acceleration sensor according to motion of the first electronic device 101 and store the same in the storage unit 120. The control unit 150 may also collect geomagnetic sensor signal information through the geomagnetic sensor according to motion of the first electronic device 101 and store the same in the storage unit 120.

At operation 807, the control unit 150 checks whether sensing information of the second electronic device 102 is received through the communication link. If sensing information of the second electronic device 102 is received, the control unit 150 compares the received sensing information of the second electronic device 102 with the collected sensing information of the first electronic device 101 at operation 809. Here, detected signal patterns reflecting motion of the first electronic device 101 are compared with those reflecting motion of the second electronic device 102 to thereby identify occurrence of a loss incident. At operation 811, the control unit 150 checks whether the received sensing information of the second electronic device 102 is similar to the collected sensing information of the first electronic device 101. If the received sensing information is dissimilar to the collected sensing information, the control unit 150 issues a loss notification and sends loss information to the second electronic device 102 at operation 813. Here, the loss notification may be issued using vibration or sound, and the loss notification may be displayed together with information tracking the movement path of the lost electronic device on the display unit 131.

At operation 815, the control unit 150 checks whether a termination command is issued. Here, the termination command may correspond to release of the communication link due to deactivation of wireless communication. If a termination command is issued, the procedure ends. If a termination command is not issued, the procedure returns to operation 803 and motion sensing is continued.

Figure 9:
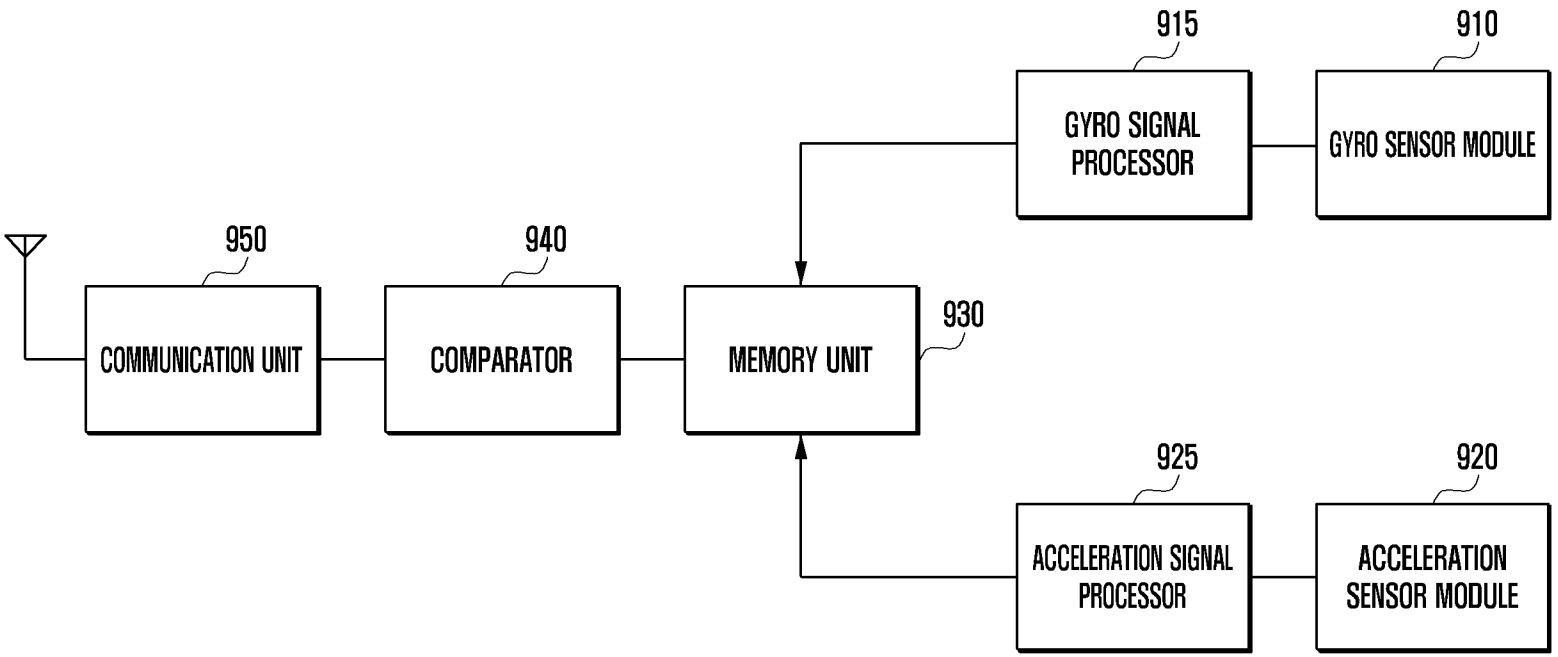
FIG. 9 is a block diagram of a second electronic device according to an embodiment of the present disclosure.

FIG. 9 is a block diagram of a second electronic device according to an embodiment of the present disclosure.

Referring to FIG. 9, the second electronic device 102 may include a gyro sensor module 910, a gyro signal processor 915, an acceleration sensor module 920, an acceleration signal processor 925, a memory unit 930, a comparator 940, and a communication unit 950.

When the second electronic device 102 is configured to support screen rotation, the gyro sensor module 910 may be activated to sense the angular velocity. Angular velocity information collected by the gyro sensor module 910 may be forwarded to the gyro signal processor 915. The angular velocity information may include information on rotation along at least one of the x-axis, y-axis and z-axis. Sensing information collected by the gyro sensor module 910 may include information on the angular velocity about at least one of the x-axis, y-axis and z-axis.

The gyro signal processor 915 may receive sensing information collected by the gyro sensor module 910 and forward the same to the memory unit 930.

The acceleration sensor module 920 may sense acceleration due to motion (such as rotation) of the second electronic device 102. Acceleration information collected by the acceleration sensor module 920 may be forwarded to the acceleration signal processor 925.

The acceleration signal processor 925 may receive sensing information related to acceleration collected by the acceleration sensor module 920 and forward the same to the memory unit 930.

The memory unit 930 may store sensing information of the second electronic device 102 collected by the gyro sensor module 910 and/or the acceleration sensor module 920.

The comparator 940 may analyze sensing information collected by the gyro sensor module 910 and/or the acceleration sensor module 920 to identify signal patterns for determining occurrence of a loss incident. For example, the comparator 940 may compare sensing information of the second electronic device 102 stored in the memory unit 430 with sensing information received from the first electronic device 101.

The communication unit 950 may send sensing information of the second electronic device 102 collected by the gyro sensor module 910 and/or the acceleration sensor module 920 to the first electronic device 101. The communication unit 950 may receive sensing information of the first electronic device 101 therefrom. In addition, when the result of comparison by the comparator 940 indicates occurrence of a loss incident, the communication unit 950 may send loss information to the first electronic device 101.

Figure 10:
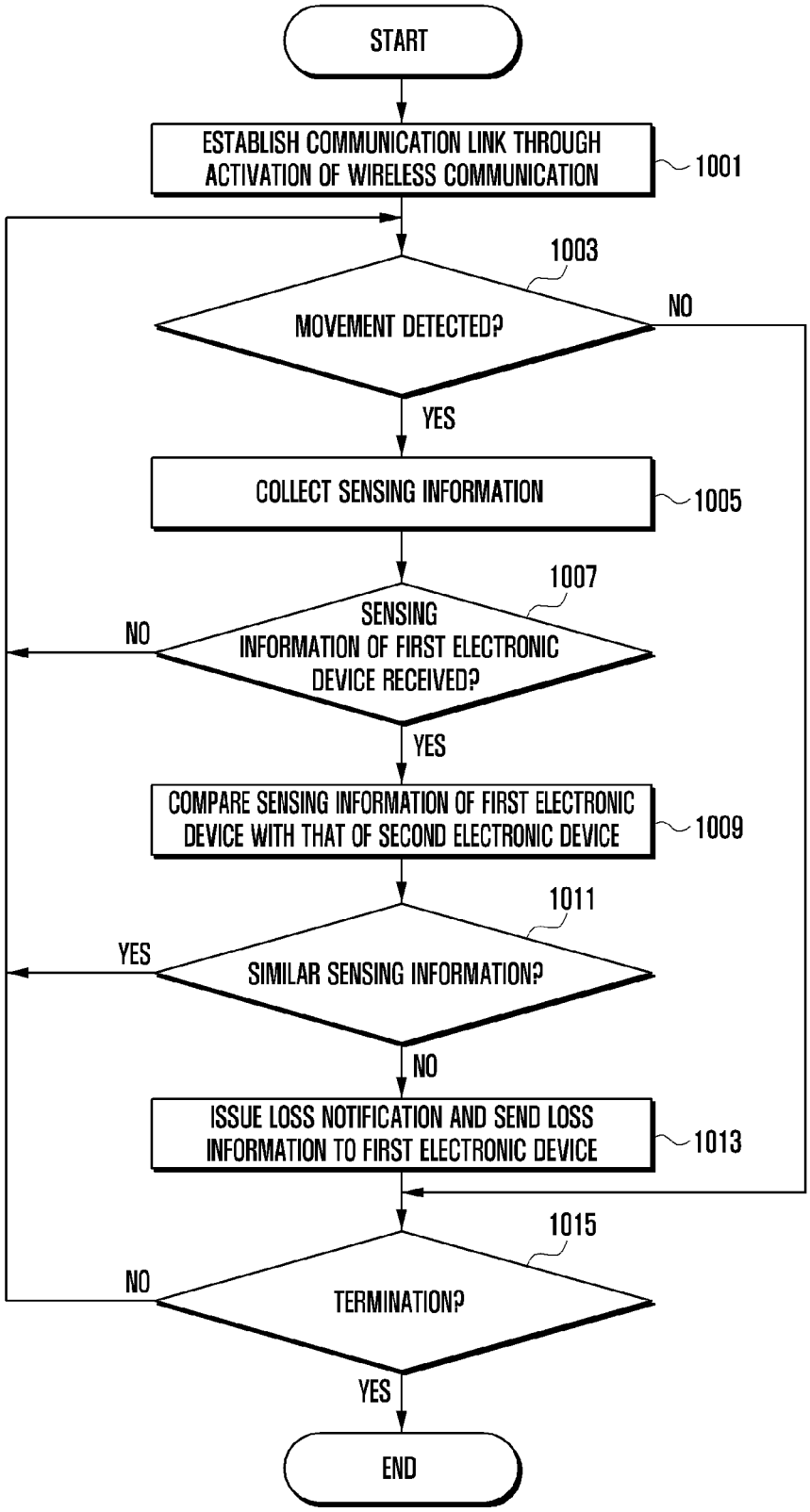
FIG. 10 is a flowchart of a loss prevention method for a second electronic device according to an embodiment of the present disclosure.

FIG. 10 is a flowchart of a loss prevention method for a second electronic device according to an embodiment of the present disclosure.

Referring to FIG. 10, the control unit 150 of the second electronic device 102 activates wireless communication and establishes a communication link with another electronic device at operation 1001. Here, it is assumed that the communication link is established between the first electronic device 101 and the second electronic device 102. After establishment of the communication link, the control unit 150 checks whether motion of the second electronic device 102 is detected at operation 1003. If motion of the second electronic device 102 is detected, the control unit 150 controls the sensor unit 140 to collect sensing information of the second electronic device 102 at operation 1005. Here, the sensing information may be collected by an acceleration sensor and/or a geomagnetic sensor sensing motion of the second electronic device 102. For example, the control unit 150 may collect acceleration sensor signal information through the acceleration sensor according to motion of the second electronic device 102 and store the same in the storage unit 120. The control unit 150 may also collect geomagnetic sensor signal information through the geomagnetic sensor according to motion of the second electronic device 102 and store the same in the storage unit 120.

At operation 1007, the control unit 150 checks whether sensing information of the first electronic device 101 is received through the communication link. If sensing information of the first electronic device 101 is received, the control unit 150 compares the received sensing information of the first electronic device 101 with the collected sensing information of the second electronic device 102 at operation 1009. At operation 1011, the control unit 150 checks whether the received sensing information of the first electronic device 101 is similar to the collected sensing information of the second electronic device 102. If the received sensing information is dissimilar to the collected sensing information, the control unit 150 issues a loss notification and sends loss information to the first electronic device 101 at operation 1013. Here, the loss notification may be issued using vibration or sound, and the loss notification may be displayed together with information tracking the movement path of the lost electronic device on the display unit 131.

At operation 1015, the control unit 150 checks whether a termination command is issued. Here, the termination command may correspond to release of the communication link due to deactivation of wireless communication. If a termination command is issued, the procedure ends. If a termination command is not issued, the procedure returns to operation 1003 and motion sensing is continued.

Figure 11:
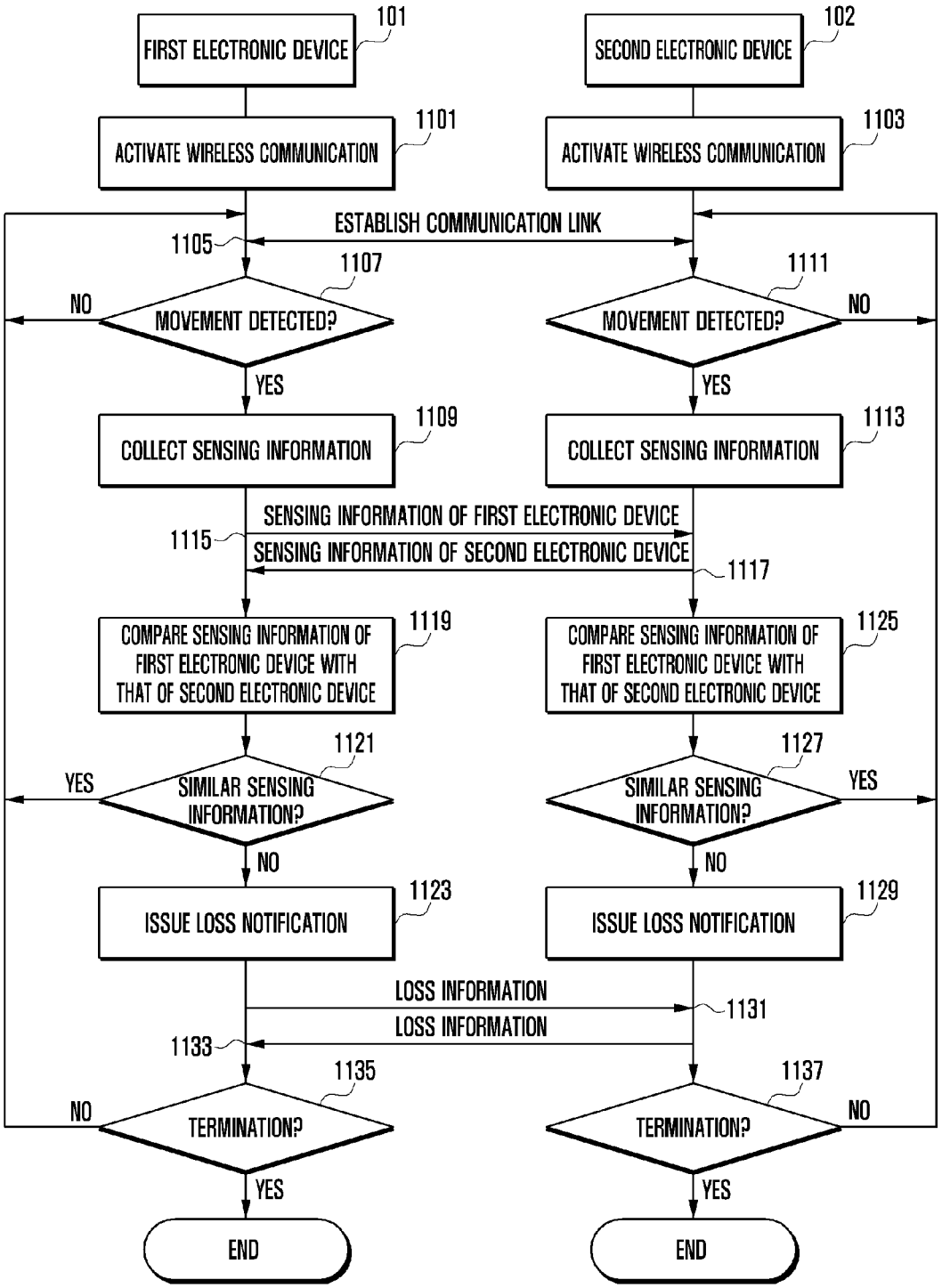
FIG. 11 illustrates signal exchange between a first electronic device and a second electronic device according to an embodiment of the present disclosure.

FIG. 11 illustrates signal exchange between a first electronic device and a second electronic device according to an embodiment of the present disclosure.

Referring to FIG. 11, the first electronic device 101 activates wireless communication at operation 1101. At operation 1103, the second electronic device 102 activates wireless communication. At operation 1105, a communication link is established between the first electronic device 101 and the second electronic device 102. At operation 1107, the first electronic device 101 checks whether motion thereof is detected. If motion of the first electronic device 101 is detected, the first electronic device 101 collects sensing information according to motion at operation 1109. At operation 1111, the second electronic device 102 checks whether motion thereof is detected. If motion of the second electronic device 102 is detected, the second electronic device 102 collects sensing information according to motion at operation 1113. At operation 1115, the first electronic device 101 sends the sensing information thereof to the second electronic device 102. At operation 1117, the second electronic device 102 sends the sensing information thereof to the first electronic device 101. The sensing information is illustrated as sent and received in sequence at operation 1115 and operation 1117. However, the present disclosure is not limited thereto, and the sensing information may be sent and received in parallel.

At operation 1119, the first electronic device 101 compares the received sensing information of the second electronic device 102 with the collected sensing information of the first electronic device 101. Here, detected signal patterns reflecting motion of the first electronic device 101 are compared with those reflecting motion of the second electronic device 102 to thereby identify occurrence of a loss incident. At operation 1121, the first electronic device 101 checks whether the received sensing information of the second electronic device 102 shows a signal pattern similar to that of the collected sensing information of the first electronic device 101. If the received sensing information shows a signal pattern similar to that of the collected sensing information, the first electronic device 101 returns to operation 1105. If the received sensing information shows a signal pattern dissimilar to that of the collected sensing information, the first electronic device 101 issues a loss notification at operation 1123. At operation 1131, the first electronic device 101 sends loss information to the second electronic device 102.

At operation 1125, the second electronic device 102 compares the received sensing information of the first electronic device 101 with the collected sensing information of the second electronic device 102. At operation 1127, the second electronic device 102 checks whether the received sensing information of the first electronic device 101 shows a signal pattern similar to that of the collected sensing information of the second electronic device 102. If the received sensing information shows a signal pattern similar to that of the collected sensing information, the second electronic device 102 returns to operation 1111. If the received sensing information shows a signal pattern dissimilar to that of the collected sensing information, the second electronic device 102 issues a loss notification at operation 1129. At operation 1133, the second electronic device 102 sends loss information to the first electronic device 101.

Following operation 1133, the first electronic device 101 checks whether a termination command is issued at operation 1135. Here, the termination command may correspond to release of the communication link due to deactivation of wireless communication. If a termination command is issued, the procedure ends. If a termination command is not issued, the procedure returns to operation 1105. Similarly, following operation 1131, the second electronic device 102 checks whether a termination command is issued at operation 1137. Here, the termination command may correspond to release of the communication link due to deactivation of wireless communication. If a termination command is issued, the procedure ends. If a termination command is not issued, the procedure returns to operation 1105.

As another embodiment, in the following description with reference to FIGS. 12 and 13, it is assumed that the first electronic device 101 is a wearable device and the second electronic device 102 is a mobile device. It is also assumed that whether the mobile device is lost is checked when the wearable device is worn by the user. FIG. 12 illustrates signal patterns according to motion of the wearable device and mobile device, which may be used for determining occurrence of a loss incident. To check occurrence of a loss incident, sensing information of one electronic device collected by the acceleration sensor module and/or the gyro sensor module is compared with sensing information of another electronic device collected by the acceleration sensor module and/or the gyro sensor module. For example, sensing information of the wearable device due to motion is compared with sensing information of the mobile device due to motion. If the two pieces of sensing information show a similar signal pattern, it may be determined that a loss incident has not occurred. And, if the two pieces of sensing information show different signal patterns, it may be determined that a loss incident has occurred and a loss notification may be issued.

FIG. 12 illustrates signal patterns based on sensing information used to determine occurrence of a loss incident according to an embodiment of the present disclosure.

FIG. 12 shows some sensor signal patterns indicating a situation where the wearable device is worn by the user and the mobile device is owned by the user. For example, owing to movement of the wearable device, the acceleration sensor module may produce a signal pattern as indicated by <a> and the gyro sensor module may produce a signal pattern as indicated by <b>. Owing to movement of the mobile device, the acceleration sensor module may produce a signal pattern as indicated by <c> and the gyro sensor module may produce a signal pattern as indicated by <d>. To determine whether the mobile device is lost, signal patterns <a> and <c> of the acceleration sensor modules may be compared and signal patterns <b> and <d> of the gyro sensor modules may be compared. This comparison may indicate that the acceleration sensor modules of the wearable device and the mobile device produce similar signal patterns and the gyro sensor modules of the wearable device and the mobile device produce similar signal patterns. As such, when sensing information shows a similar signal pattern, it may be determined that the mobile device is owned by the user. In other words, when sensing information of the wearable device due to motion (e.g., signals produced by the acceleration sensor module and gyro sensor module) shows a signal pattern similar to that of sensing information of the mobile device due to motion (e.g., signals produced by the acceleration sensor module and gyro sensor module), it can be determined that the mobile device is owned by the user and a loss notification may not be issued.

Signal patterns <a> and <b> may be generated, for example, when the user walks while wearing the wearable device. Similarly, signal patterns <c> and <d> may be generated, for example, when the user walks while carrying the mobile device.

As another example of a situation where the wearable device is worn by the user and the mobile device is owned by the user, owing to movement of the wearable device, the acceleration sensor module may produce a signal pattern as indicated by <e> and the gyro sensor module may produce a signal pattern as indicated by <f. Owing to non-movement of the mobile device, the acceleration sensor module may produce a signal pattern as indicated by <g> and the gyro sensor module may produce a signal pattern as indicated by <h>. To determine whether the mobile device is lost, signal patterns <e> and <g> of the acceleration sensor modules may be compared and signal patterns <f> and <h> of the gyro sensor modules may be compared. When signal patterns indicate that the mobile device is not in motion while the wearable device is in motion, it may be determined that the mobile device is not lost. For example, as the wearable device is worn by the user, sensing information of the wearable device may show a signal pattern denoting movement caused by the user. When the mobile device is not in use, sensing information of the mobile device may show a signal pattern denoting non-movement. In such a case, it can be determined that a loss incident has not occurred and a loss notification may be not issued.

Signal patterns <e> and <f> may be generated, for example, when the user is wearing the wearable device. Signal patterns <g> and <h> may be generated, for example, when the mobile device is placed on a table and is not in use. In addition, the mobile device may be separated by some distance from the wearable device.

In addition, FIG. 12 shows some sensor signal patterns indicating a situation where the wearable device is worn by the user and the mobile device is lost. For example, owing to movement of the wearable device, the acceleration sensor module may produce a signal pattern as indicated by <i> and the gyro sensor module may produce a signal pattern as indicated by <j>. Owing to movement of the mobile device, the acceleration sensor module may produce a signal pattern as indicated by <k> and the gyro sensor module may produce a signal pattern as indicated by <l>. To determine whether the mobile device is lost, signal patterns <i> and <k> of the acceleration sensor modules may be compared and signal patterns <j> and <l> of the gyro sensor modules may be compared. This comparison may indicate that the acceleration sensor modules of the wearable device and the mobile device produce dissimilar signal patterns; and the gyro sensor modules of the wearable device and the mobile device produce dissimilar signal patterns. As such, when sensing information shows dissimilar signal patterns, it may be determined that the mobile device is lost. Specifically, it can be seen that signal patterns <k> and <l> of the mobile device are different from signal patterns <i> and <j> of the wearable device and vary independently of the signal patterns <i> and <j>. Here, signal patterns of the mobile device may be regarded as varying independently of signal patterns of the wearable device when signal values of the mobile device change abruptly in terms of direction, distance or axis in comparison with signal values of the wearable device (e.g., signal values greater than a preset threshold, or signal values reversed with respect to at least one of the x-axis, y-axis and z-axis). In other words, when sensing information of the wearable device due to motion (e.g., signals produced by the acceleration sensor module and gyro sensor module) shows a signal pattern dissimilar to that of sensing information of the mobile device due to motion (e.g., signals produced by the acceleration sensor module and gyro sensor module), it can be determined that the mobile device is lost and a loss notification may be issued.

As another example of a situation where the wearable device is worn by the user and the mobile device is lost, owing to non-movement of the wearable device, the acceleration sensor module may produce a signal pattern as indicated by <m> and the gyro sensor module may produce a signal pattern as indicated by <n>. Owing to movement of the mobile device, the acceleration sensor module may produce a signal pattern as indicated by <o> and the gyro sensor module may produce a signal pattern as indicated by <p>. To determine whether the mobile device is lost, signal patterns <m> and <o> of the acceleration sensor modules may be compared and signal patterns <n> and <p> of the gyro sensor modules may be compared. When signal patterns indicate that the wearable device is not in motion while the mobile device is in motion, it may be determined that the mobile device is lost. For example, it can be seen that signal patterns <o> and <p> of the mobile device are different from signal patterns <m> and <n> of the wearable device and vary independently of the signal patterns <m> and <n>. Here, signal patterns of the mobile device may be regarded as varying independently of signal patterns of the wearable device when signal values of the mobile device change abruptly in terms of direction, distance or axis in comparison with signal values of the wearable device (e.g., signal values greater than a preset threshold, or signal values reversed with respect to at least one of the x-axis, y-axis and z-axis). In other words, when sensing information of the wearable device (e.g., signals produced by the acceleration sensor module and gyro sensor module) indicates non-movement and sensing information of the mobile device (e.g., signals produced by the acceleration sensor module and gyro sensor module) indicates movement, it can be determined that the mobile device is lost and a loss notification may be issued.

Figure 13:
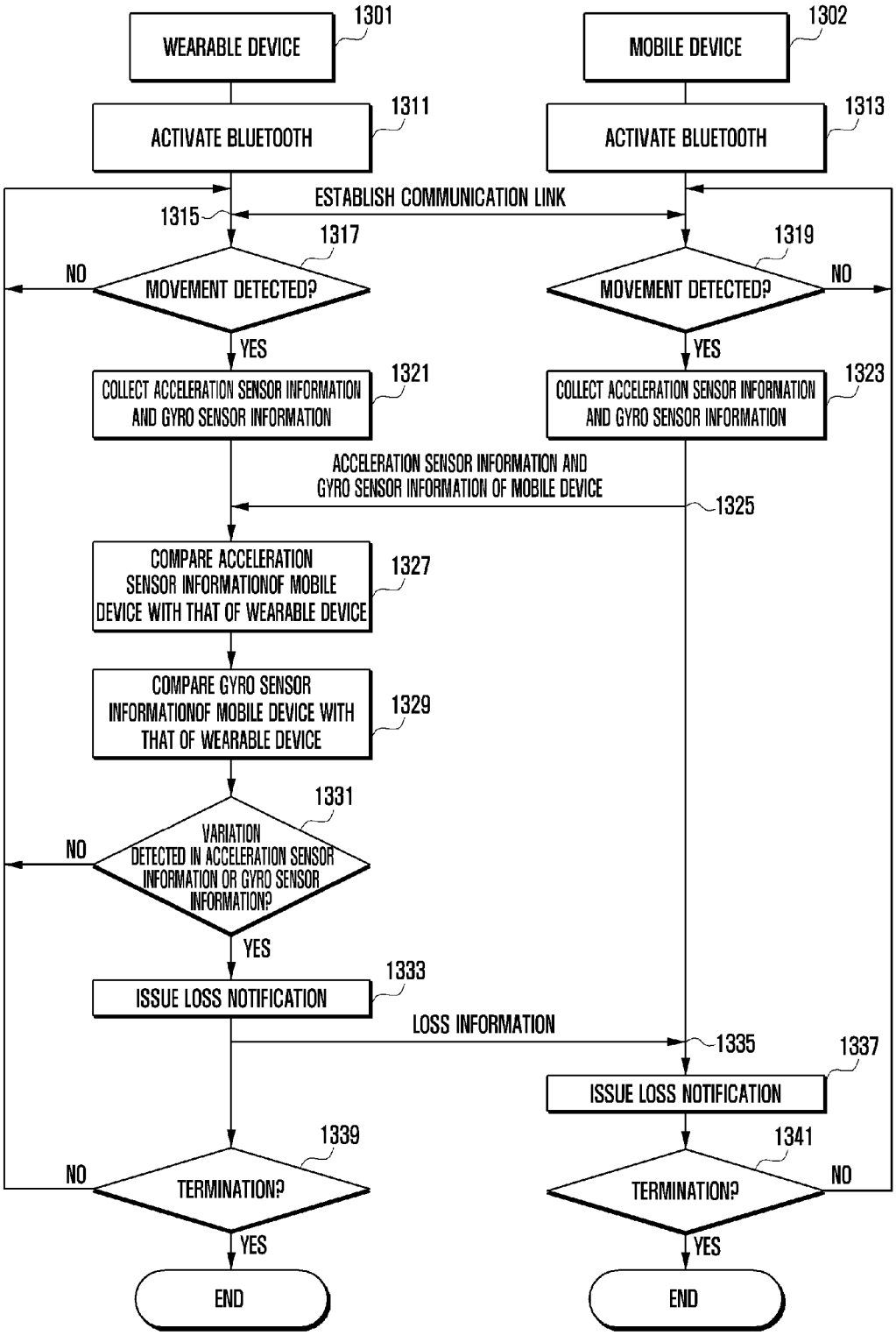
FIG. 13 illustrates signal exchange between a first electronic device and a second electronic device according to an embodiment of the present disclosure.

FIG. 13 illustrates signal exchange between a first electronic device and a second electronic device according to an embodiment of the present disclosure.

In the following description with reference to FIG. 13, it is assumed that the first electronic device 101 is a wearable device 1301 and the second electronic device 102 is a mobile device 1302. It is also assumed that Bluetooth communication is used to establish a communication link between the wearable device 1301 and the mobile device 1302, and the wearable device 1301 checks occurrence of a loss incident and sends loss information to the mobile device 1302.

Referring to FIG. 13, the wearable device 1301 activates Bluetooth communication at operation 1311. At operation 1313, the mobile device 1302 activates Bluetooth communication. At operation 1315, a Bluetooth communication link is established between the wearable device 1301 and the mobile device 1302. Thereafter, at operation 1317, the wearable device 1301 checks whether motion thereof is detected. If motion of the wearable device 1301 is detected, the wearable device 1301 collects sensing information according to motion at operation 1321. Here, the sensing information may be collected by the acceleration sensor module and/or the gyro sensor module (i.e., sensor unit 140) sensing motion of the wearable device 1301.

At operation 1319, the mobile device 1302 checks whether motion thereof is detected. If motion of the mobile device 1302 is detected, the mobile device 1302 collects sensing information according to motion at operation 1323. Here, the sensing information may be collected by the acceleration sensor module and/or the gyro sensor module (i.e., sensor unit 140) sensing motion of the mobile device 1302.

At operation 1325, the mobile device 1302 sends the sensing information collected by the acceleration sensor module and/or the gyro sensor module to the wearable device 1301. At operation 1327, the wearable device 1301 compares the received acceleration sensor signal information of the mobile device 1302 with the collected acceleration sensor signal information of the wearable device 1301. At operation 1329, the wearable device 1301 compares the received gyro sensor signal information of the mobile device 1302 with the collected gyro sensor signal information of the wearable device 1301. Here, acceleration sensor signals of the devices are compared first and then gyro sensor signals are compared. However, the present disclosure is not limited thereto. For example, gyro sensor signals may be compared first and then acceleration sensor signals may be compared. Or, comparison between acceleration sensor signals and comparison between gyro sensor signals may be performed at the same time. Comparison operations may be conducted through comparison between signal patterns produced by the wearable device 1301 and the mobile device 1302 as described before in connection with FIG. 12.

At operation 1331, the wearable device 1301 checks whether at least one of the gyro sensor signal and the acceleration sensor signal of the mobile device 1302 shows a signal pattern varying independently of signal patterns of the wearable device 1301. Here, a signal pattern of the mobile device may be regarded as varying independently of signal patterns of the wearable device when signal values of the mobile device change abruptly in terms of direction, distance or axis in comparison with signal values of the wearable device (e.g., signal values of the mobile device are greater than those of the wearable device by more than a preset threshold, or signal values reversed with respect to at least one of the x-axis, y-axis and z-axis). If a signal pattern varying independently is present, the wearable device 1301 issues a loss notification at operation 1333. At operation 1335, the wearable device 1301 sends loss information to the mobile device 1302. Upon reception of the loss information, the mobile device 1302 issues a loss notification at operation 1337.

Following operation 1333, the wearable device 101 checks whether a termination command is issued at operation 1339. Here, the termination command may correspond to release of the communication link due to deactivation of wireless communication. If a termination command is issued, the procedure ends. If a termination command is not issued, the procedure returns to operation 1315. Similarly, following operation 1337, the mobile device 1302 checks whether a termination command is issued at operation 1341. Here, the termination command may correspond to release of the communication link due to deactivation of wireless communication. If a termination command is issued, the procedure ends. If a termination command is not issued, the procedure returns to operation 1315.

In a feature of the present disclosure, to determine and report occurrence of a loss incident, pieces of sensing information related to motion obtained from a first electronic device and a second electronic device connected through a communication link are compared. Hence, more reliable loss detection and reporting are possible, contributing to prevention of the loss of electronic devices.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A method of loss prevention for electronic devices, the method comprising:

establishing a communication link between a first electronic device and a second electronic device;

collecting, upon detection of movement of the first electronic device, sensing information for the movement of the first electronic device;

receiving sensing information for the movement of the second electronic from the second electronic device through the communication link;

determining whether the sensing information for the movement of the first electronic device shows a signal pattern similar to that of the sensing information for the movement of the second electronic device;

determining that a loss of the second electronic device has not occurred when the sensing information for the movement of the first electronic device and the sensing information for the movement of the second electronic device show similar signal patterns; and determining that the loss of the second electronic device has occurred when the sensing information for the movement of the first electronic device and the sensing information for the movement of the second electronic device show dissimilar signal patterns.

2. The method of claim 1, wherein the determining of whether the loss of the second electronic device comprises:

generating, upon determining that the loss of the second electronic device has occurred, a loss notification; and sending loss information to the second electronic device through the communication link.

3. The method of claim 2, wherein the generating of the loss notification comprises displaying the loss notification and information tracking the movement path of the second electronic device.

4. The method of claim 1, further comprising:

determining that the loss of the second electronic device has not occurred when the sensing information for the movement of the second electronic from the second electronic device is not received.

5. The method of claim 4, wherein the sensing of information for the movement of the first electronic device and the sensing of information for the movement of the second electronic device are regarded as showing dissimilar signal patterns when signal values for the movement of the second electronic device are greater than those of the first electronic device by more than a preset threshold, or when signal values of the electronic devices are reversed with respect to at least one of the x-axis, y-axis and z-axis.

6. The method of claim 1, wherein the collecting of the sensing information comprises collecting sensing information on sensor signals produced by at least one of an acceleration sensor, a gyro sensor, a proximity sensor, a Global Positioning System (GPS) module, a camera module, a motion sensor, a gravity sensor, and a vision sensor.

7. The method of claim 1, further comprising sending the collected sensing information to the second electronic device through the communication link after sensing information collection.

8. A method of loss prevention for electronic devices, the method comprising:

establishing a communication link between a first electronic device and a second electronic device;

collecting, upon detection of movement of the second electronic device, sensing information for the movement of the second electronic device;

sending the collected sensing information to the first electronic device through the communication link;

receiving determined loss information of the second electronic device based on whether the sensing information for the movement of the first electronic device shows a signal pattern similar to that of the sensing information for the movement of the second electronic device from the first electronic device; and generating, upon reception of the loss information, a loss notification of the second electronic device.

9. The method of claim 8, further comprising:

comparing, upon reception of sensing information for the movement of the first electronic device from the first electronic device through the communication link, the sensing information for the movement of the first electronic device with the collected sensing information; and determining whether a loss of the second electronic device has occurred on the basis of the comparison result.

10. An electronic device supporting loss prevention, the electronic device comprising:

a sensor unit configured to sense motion of the electronic device;

a communication unit configured to establish a communication link with a second electronic device; and a control unit configured to control a process of:

establishing the communication link with the second electronic device;

collecting, upon detection of movement of the electronic device, sensing information for the movement of the electronic device;

receiving sensing information for the movement of the second electronic from the second electronic device through the communication link;

determining whether the sensing information for the movement of the electronic device shows a signal pattern similar to that of the sensing information for the movement of the second electronic device;

determining that a loss of the second electronic device has not occurred when the sensing information show similar signal patterns; and determining that the loss of the second electronic device has occurred when the sensing information show dissimilar signal patterns.

11. The electronic device of claim 10, wherein the control unit is further configured to:

generate, upon determining that the loss of the second electronic device has occurred, a loss notification; and control the communication unit to send loss information to the second electronic device.

12. The electronic device of claim 11, wherein the control unit is further configured to control an operation to display the loss notification and information tracking the movement path of the second electronic device.

13. The electronic device of claim 10, wherein the control unit is further configured to control the determining of the loss of the second electronic device has not occurred when the sensing information for the movement of the second electronic from the second electronic device is not received.

14. The electronic device of claim 13, wherein the control unit is further configured to determine that the sensing information for the movement of the electronic device and the second electronic device show dissimilar signal patterns when signal values for the movement of the second electronic device are greater than those of the electronic device by more than a preset threshold, or when signal values of the electronic devices are reversed with respect to at least one of the x-axis, y-axis and z-axis.

15. The electronic device of claim 10, wherein the control unit is further configured to collect sensing information on sensor signals produced by at least one of an acceleration sensor, a gyro sensor, a proximity sensor, a Global Positioning System (GPS) module, a camera module, a motion sensor, a gravity sensor, or a vision sensor.

16. The electronic device of claim 10, wherein the control unit is further configured to control the communication unit to send the collected sensing information to the second electronic device through the communication link.

17. An electronic device supporting loss prevention, the electronic device comprising:

a sensor unit configured to sense motion of the electronic device;

a communication unit configured to establish a communication link with a second electronic device; and a control unit configured to control a process of:

establishing the communication link with the second electronic device;

collecting, upon detection of movement of the electronic device, sensing information for the movement of the electronic device;

sending the collected sensing information to the second electronic device through the communication link;

receiving determined loss information of the electronic device based on whether the sensing information for the movement of the electronic device shows a signal pattern similar to that of the sensing information for the movement of the second electronic device from the second electronic device; and generating a loss notification of the electronic device.

18. The electronic device of claim 17, wherein the control unit is further configured to:

receive sensing information for the movement of the second electronic from the second electronic device through the communication link;

compare the sensing information for the movement of the electronic device with the sensing information for the movement of the second electronic device; and determine whether a loss of the electronic device has occurred on the basis of the comparison result.

* * * * *